US009357608B2

(12) United States Patent
Diaz Velez

(10) Patent No.: US 9,357,608 B2
(45) Date of Patent: May 31, 2016

(54) MULTIPLEXED ULTRA-LOW-POWER LED LUMINAIRE

(71) Applicants: Institucion Universitaria Colegio Mayor de Antioquia, Medellin (CO); Juan Camilo Diaz Velez, Medellin (CO)

(72) Inventor: Juan Camilo Diaz Velez, Medellin (CO)

(73) Assignees: INSTITUCION UNIVERSITARIA COLEGIO MAYOR DE ANTIOQUIA, Medellin (CO); Juan Camilo Diaz Velez, Medellin (CO)

( * ) Notice: Subject to any disclaimer, the term of this patent is extended or adjusted under 35 U.S.C. 154(b) by 21 days.

(21) Appl. No.: 14/410,317

(22) PCT Filed: Feb. 20, 2013

(86) PCT No.: PCT/IB2013/051381
§ 371 (c)(1),
(2) Date: Dec. 22, 2014

(87) PCT Pub. No.: WO2014/001920
PCT Pub. Date: Jan. 3, 2014

(65) Prior Publication Data

US 2015/0341998 A1 Nov. 26, 2015

(30) Foreign Application Priority Data

Jun. 26, 2012 (CO) ..... 12-107200

(51) Int. Cl.
*H05B 39/00* (2006.01)
*H05B 33/08* (2006.01)

(52) U.S. Cl.
CPC ..... *H05B 33/0845* (2013.01); *H05B 33/0803* (2013.01); *H05B 33/0887* (2013.01)

(58) Field of Classification Search
CPC ..... H05B 33/0818; Y10S 362/80; F21Y 2101/02; F21Y 2105/001; F21Y 2113/005
See application file for complete search history.

(56) References Cited

U.S. PATENT DOCUMENTS

| | | | | |
|---|---|---|---|---|
| 5,850,126 | A | 12/1998 | Kanbar | |
| 6,329,760 | B1 | 12/2001 | Bebenroth | |
| 7,740,371 | B1 * | 6/2010 | Lebens | F21L 4/027 315/127 |
| 2005/0195600 | A1 | 9/2005 | Porchia et al. | |

FOREIGN PATENT DOCUMENTS

FR 2631102 A1 11/1989

* cited by examiner

*Primary Examiner* — Douglas W Owens
*Assistant Examiner* — Monica C King
(74) *Attorney, Agent, or Firm* — Lucas & Mercanti, LLP

(57) ABSTRACT

The present invention relates to a luminaire based on the same optical principle as the cinema, in which only one image is presented at any given instant of time but the image appears to be in constant movement. According to the invention, each LED lights up simultaneously for an instant of time in a sequential manner, as with television screens. The LED luminaire of the invention includes a configuration of electronic elements in a circuit which controls the lighting of the LED array and which also includes a PIC microcontroller, a CMOS multiplexer and an operational amplifier that can be used to improve the power consumption of the luminaire, lighting control and the lighting quality of the LED luminaire.

7 Claims, 3 Drawing Sheets

Figure 1:
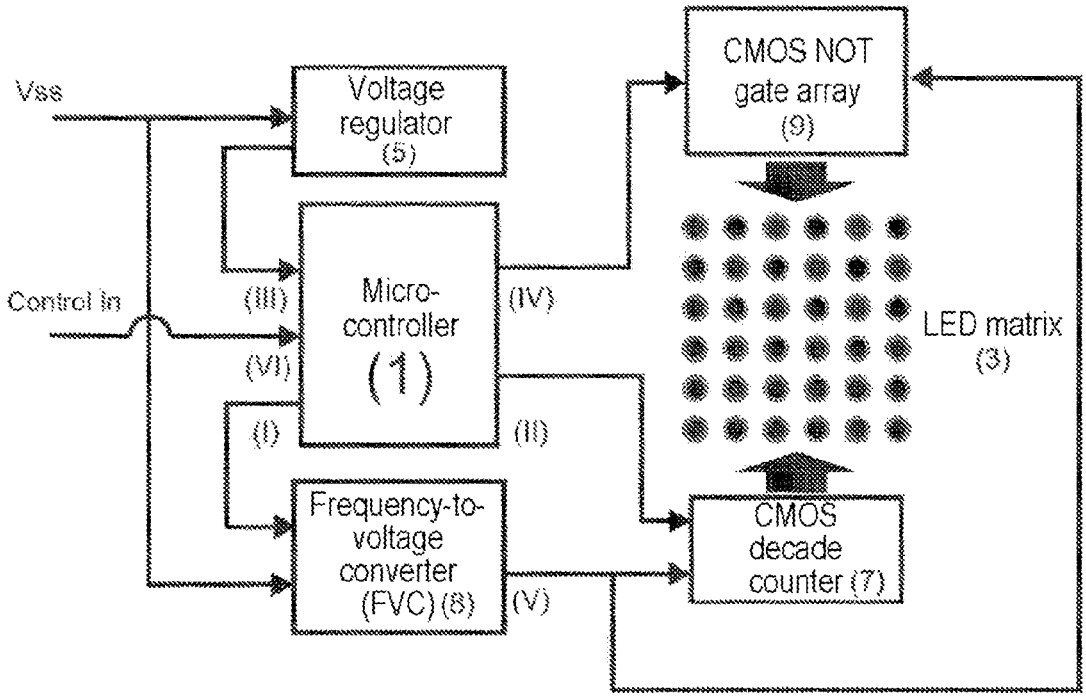

Circuit diagram of an embodiment of the luminaire according to the invention (JCDLLM08)

Diagram of components of the LED luminaire according to the present invention (JCDLLM08)

Circuit diagram of an embodiment of the luminaire according to the invention (JCDLLM08)

Flow diagram of the step sequence of the program of the controller of the microcontroller of the LED luminaire according to the invention (JCDLLM08)

MULTIPLEXED ULTRA-LOW-POWER LED LUMINAIRE

CROSS REFERENCE TO RELATED APPLICATION

This Application is a 371 of PCT/IB2013/051381 filed on Feb. 20, 2013 which, in turn, claimed the priority of Colombian Patent Application No. 12-107200 filed on Jun. 26, 2012, both applications are incorporated herein by reference.

FIELD OF THE INVENTION

The luminaire according to the present invention is based on the same optical principle as the cinema, at which only one image is presented at any given instant of time, but the image appears to be in constant movement. In this case, each LED lights up simultaneously for an instant of time in a sequential manner, as with television screens.

Specifically, the luminaire according to the invention is designed for power supplies of between 6 and 15 V DC to replace incandescent or fluorescent luminaires between 700 and 1400 lumens and is based on the principle of multiplexing, in which only one of the LEDs making up the illumination matrix lights up for a fraction of a second at such high speeds that the human eye perceives them all to be lit up.

PRIOR ART

Efforts to save energy have resulted in a search for new lighting methods, such as the use of LED luminaires. LED luminaires have advantages over conventional means of lighting, such as tungsten lamps and fluorescent lamps, since they have a useful life of more than 50,000 hours, they emit no perceptible heat and they draw up to 90% less energy than conventional lighting means.

The energy saving achieved by LED luminaires is causing traditional tungsten lamps and fluorescent lamps to disappear and to be replaced by these luminaires, which have very low energy consumption. In light of this situation, despite the considerable saving obtained by using LED luminaires, efforts have been made to minimize further the energy consumption of said LED luminaires. In this context, various attempts have been made to create a product focused on energy saving that is more efficient than known products and that simultaneously maximizes luminous intensity.

In an attempt to find said product, various patent documents have been produced, including patent FR 2631102, which discloses a lamp that includes a light source comprising LEDs divided into sectors powered in parallel by battery, characterized by a voltage-step up circuit with cut-off inserted between one of the poles of the battery and the light source sectors. Said document also includes a multiplexed circuit inserted between the other pole of the battery and the sectors that it connects to this other pole in a cyclical manner one by one and in turn. The diode lamp in this document has low energy consumption and the cyclical illumination method occurs at sufficient velocity to give the impression of continuous illumination to the human eye.

Another document, intended to obtain a screw-in LED lamp for use in traffic lights, is patent U.S. Pat. No. 5,850,126. Said patent claims a lamp that includes: a bank of interconnected LED elements, a plug adapted to screw into an AC power line; and an electronic pulse activation unit connected to the plug to convert the alternating current into periodic direct current voltage pulses and to apply these pulses to the bank of LED elements to cause flashing. These pulses have a repetition rate producing visual persistence whereby the light flashes are seen as a steady light. The voltage pulses applied to the LED elements have a greater magnitude than the normal current value and the pulse duration is a few microseconds, making the intensity of the light generated greater than the light generated with a normal current. The foregoing occurs without the LED elements being damaged by the high-intensity current passing through same with each pulse. This patent document discloses a circuit that controls a group of LED lights, causing them to provide high-intensity pulsed illumination that is perceived to be steady illumination while simultaneously reducing power consumption. These features include an AC/DC regulator combined with a pulse generator, but do not include an oscillator combined with a PIC processor and a CMOS multiplexer for the assembly of the electronic elements in the invention.

To complement the existing information in the prior art, it is necessary to include document U.S. Pat. No. 6,329,760, which relates to a circuit for operating a lamp that includes a first pulse generator for generating a first series of pulses having a frequency of more than 10 Hz and a second pulse generator generating a second series of pulses, and which can be switched on or turned off by the first pulse generator by means of the connection of said circuit to a voltage source and to the lamp. The pulse sequence preferably has a period with no pulses that is at least as long as the pulse period. As such, the circuit generates a series of pulses with a rectangular voltage wave at a frequency of approximately 16 Hz. The light emitting diode is illuminated such that it appears to be illuminated continuously to the human eye, although the diode is illuminated intermittently. The sum of effects from the cyclical on/off change and the generation of a high self-induction voltage causes the same effect as an LED lamp operated with a constant current. This invention results in 10% less power consumption than the original.

This patent document discloses a circuit that controls a group of LED lights, causing them to provide high-intensity pulsed illumination that is perceived to be steady illumination while simultaneously reducing power consumption. Specifically, U.S. Pat. No. 6,329,760 mentions two different pulse generators. However, said publication does not mention the use of an oscillator with a PIC microcontroller.

In addition to the aforementioned documents, the prior art search revealed patent application US 2005195600 A1, which makes reference to a luminaire for ambient lighting that contains a microcontroller that uses pulse modulation to alter the pulse period to change the luminous intensity of the LED without the use of a multiplexed matrix, and a radiofrequency receiver that receives the signals sent by the remote control of the luminaire.

Despite the advances already made in terms of energy saving in LED luminaires, the prior art reveals an obvious need for an LED luminaire that provides direct and constant energy consumption, that includes the property of multiplexing the illumination with a view to reducing the electrical power required by the consumption unit of the LED matrix and that maximizes the per-unit lighting intensity in a multiplexed illumination system.

Accordingly, the LED luminaire required in the prior art must include a layout of electronic elements of a circuit that controls the illumination of the LED matrix and that as a whole also includes a PIC microcontroller, a CMOS multiplexer, an operational amplifier that improves the power consumption of the luminaire, the control of the illumination and the lighting quality of the LED luminaire.

DETAILED DESCRIPTION OF THE DRAWINGS

FIG. 1. Diagram of the components of the luminaire according to the invention.

Figure 2:
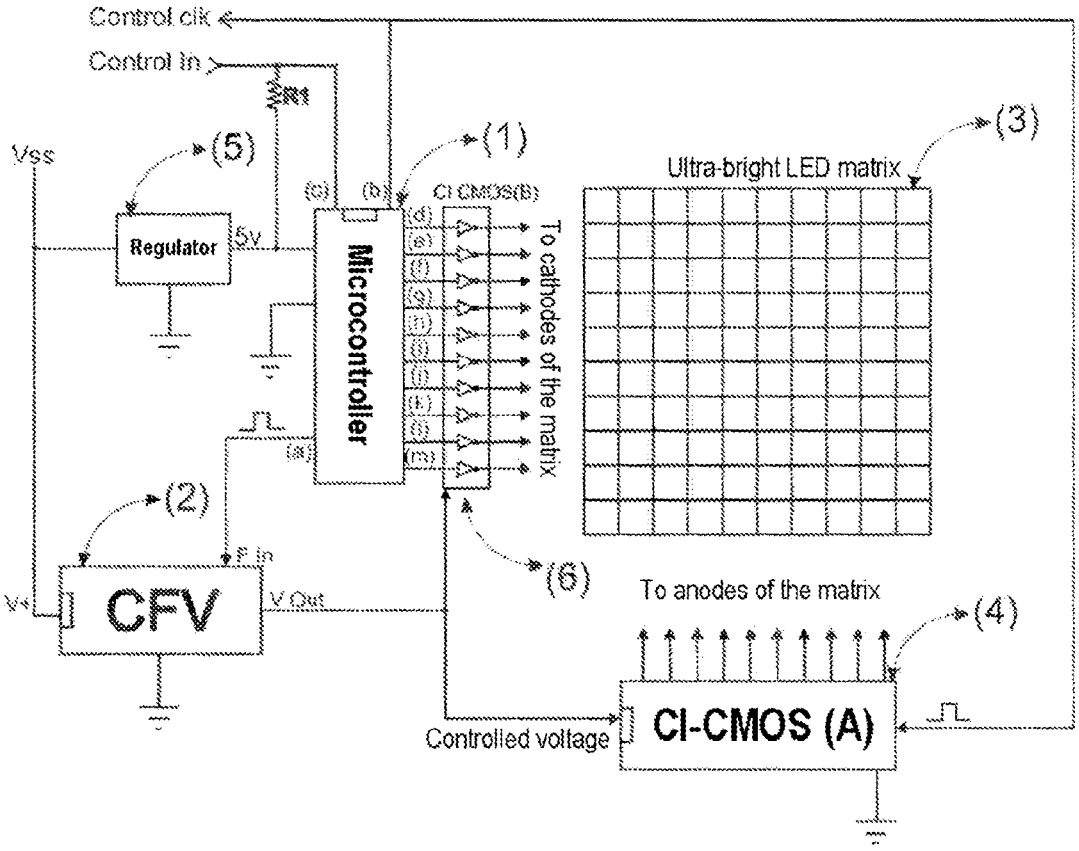

FIG. 2. Circuit diagram of an embodiment of the luminaire according to the invention.

Figure 3:
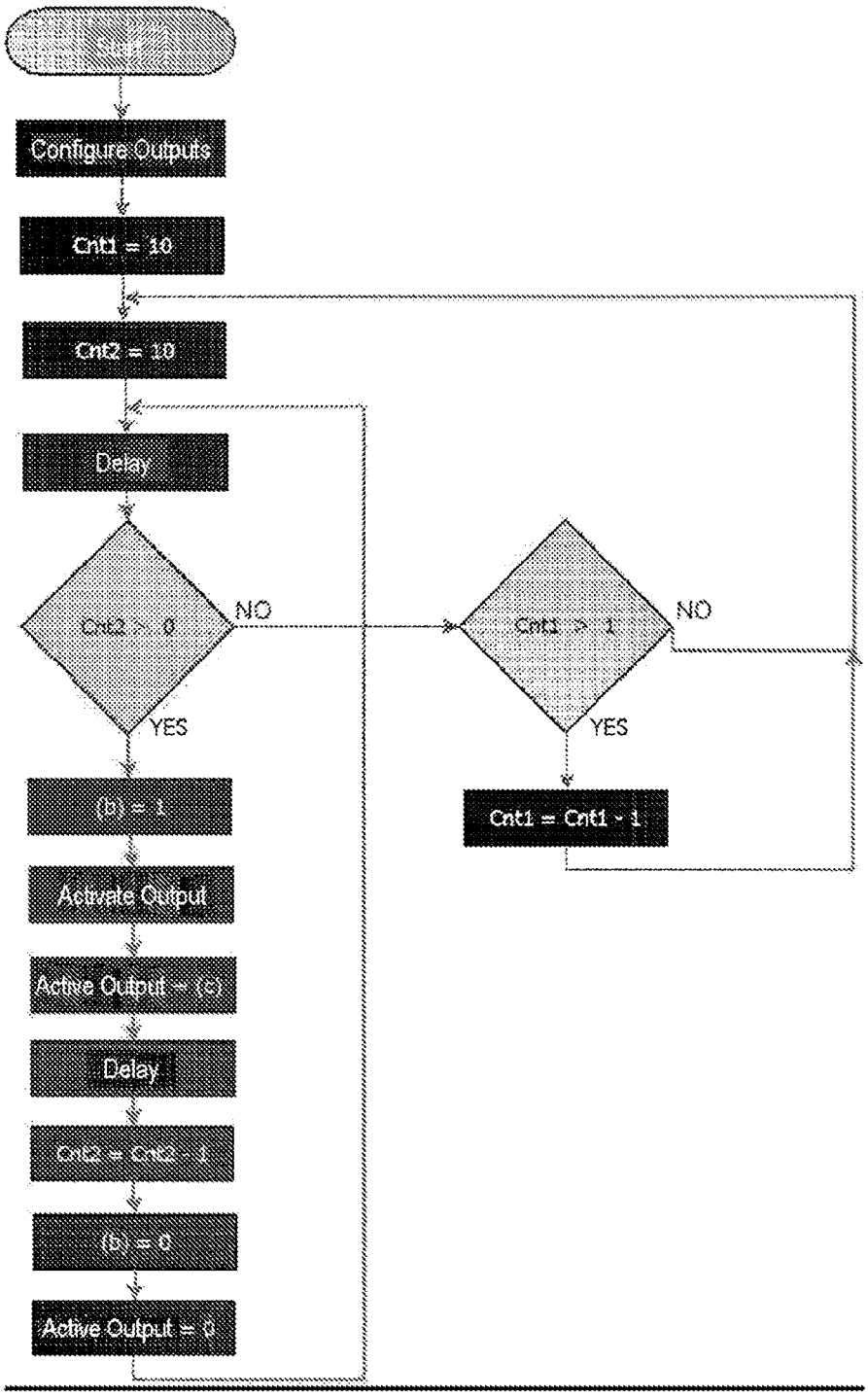

FIG. 3. Flow diagram of the sequence of steps of the program run by the controller of the microcontroller.

DETAILED DESCRIPTION OF THE INVENTION

The luminaire according to the present invention is a multiplexed LED matrix with individual-unit power control. This luminaire is designed not to keep each LED illuminated simultaneously, but to light them up one by one for milliseconds, controlling the power applied in order to maximize the luminosity of same, obtaining the same light quality with an energy draw similar to the LED unit and the control circuits used. Another feature of this invention is that operation of the luminaire can be controlled to display different display patterns.

On account of the consumption and power supply features of same, the luminaire according to the invention is ideal for use with alternative generation sources, such as wind turbines, photovoltaic panels and piezoelectric generators. However, it can be used in any local electricity network with a suitable voltage adapter.

FIG. 1 shows a block diagram of the components of the luminaire according to the invention, said luminaire including a voltage regulator (5) that supplies the required voltage to a microcontroller (1). The microcontroller (1) is used to multiplex the illumination and to control the process. The luminaire according to the invention also includes an operational amplifier or frequency-to-voltage converter (FVC) (8) that increases the voltage of the CMOS decade counter (7) and of the CMOS NOT gate array (9), which are used to control the power of the LED matrix (3).

Description of Electronic Operation of the Luminaire According to the Invention The microcontroller (1) contains a step sequence program, as shown in FIG. 3. Using this program, the microcontroller (1) controls the CMOS (7) and the CMOS NOT gate array (9), which are used to control the LED matrix (3).

When the luminaire is turned on, Vss powers the microcontroller (1) and the FVC (8) at the grid voltage, which may be between 6 and 15 V DC, which triggers said step sequence of the program of the microcontroller (1).

The output of the FVC (8) is 5 V, activating the CMOS (7) and the CMOS NOT gate array (9). After ten complete cycles of the sequence of the program, the frequency at (I) reaches the maximum required by the FVC (8) with an increase of 10% for each cycle, so that it provides the CMOS (7) and (9) through (V) with a value close to Vss, such that the lighting reaches the maximum level thereof.

Description of Operation of the Program of the Microcontroller

At the start of the program of the PIC (1), the outputs and inputs corresponding to the output (I) of the microcontroller (1) to the FVC (8), the output (II) of the PIC (1) to the CMOS decade counter (7), the output pins (IV) of the microcontroller (1) to the CMOS (9) and the pin (VI) of the microcontroller (1) as control input are configured.

Cnt1 and Cnt2 match the value corresponding to the number of output pins of the microcontroller (1) and the delay function is then called, which has a waiting time that is defined by the value Cnt1 and the multiplexing cycle starts.

FIG. 3 shows how the variables Cnt1 and Cnt2 are managed during the step sequence of the program of the microcontroller. The value of Cnt1 is the multiplier of the delay for the entire process, and Cnt2 is a constant counter that handles the output variation to the matrix (3). When Cnt2 is equal to 10, the initial value in the sequence, the active output is the first output pin in (IV) from the microcontroller (1) to the CMOS (9) and each decrement unit corresponds to the next output pin (IV) until Cnt2 is equal to 1, which means that the active output is the last output pin (IV). The output (I) that goes to the FVC (8) is identical to the last output pin (IV). Nonetheless, a different pin is used to prevent the risk of overloading.

Multiplexing Cycle

The multiplexing cycle is run indefinitely until the luminaire is turned off. In the first ten cycles there is a consistent change in a decrement of the time in the delay function so that there is time to stabilize the internal oscillator of the microcontroller (1). The cycle starts by making the output (II) high and matches the state of the output of the first output pin (IV) to the datum read at the input (VI), then it waits for the time defined by delay, decreases Cnt2 and returns to (II) and to the first output pin (IV), then it returns to the point of the first call to the delay function. On returning to the decision point at which Cnt2 is compared, the value of Cnt2 will have had a decrement of one unit, on account of which the active output is no longer the first output pin (IV) of the microcontroller (1) but the next pin (IV) and so on until the last pin (IV) of the microcontroller is reached.

Reduction of Cnt1

In the final multiplexing cycle when Cnt2=0 and the active output is the last output pin (IV), the decision point Cnt2>0 sends the pointer of the program to the second decision point Cnt1>1. This will be true for the first nine cycles of the program, but from the ninth it will always be false, moving the pointer of the program to the reload of Cnt2 and therefore restarting the multiplexing cycle.

Description of an Embodiment of the Luminaire According to the Present Invention As shown in FIG. 2, one embodiment of the luminaire according to the present invention is formed by five integrated circuits controlled by a microcontroller (1). Said microcontroller (1) is used to multiplex the illumination and receive the external signal. The luminaire also includes a voltage regulator (5) which is used to continuously supply the voltage required by the microcontroller (1). The voltage provided is 5 V.

In said embodiment, the CMOS decade counter (7) and the CMOS (9) are integrated CMOS circuits (4) and (6) (hereinafter CI-CMOS (A) and (B) respectively), said CI-CMOS (A) and (B) control the power of the LEDs of the matrix (3) once the illumination operation has started and once the microcontroller (1) has been stabilized. The CI-CMOS (B) is used to supply the power to the rows of the LED matrix (3), and the CI-CMOS (A) is used to control the columns of the LED matrix (3).

As shown in FIG. 2, in said embodiment of the luminaire according to the invention, the FVC (8) is configured as a frequency-to-voltage converter (2), which is used to increase the voltage to the integrated CI-CMOS circuits (A) and (B) that control the power of the LEDs of the matrix (3) once the illumination operation has started and once the microcontroller (1) has been stabilized.

Description of Electronic Operation of said Embodiment of the Invention

The microcontroller (1) contains a step sequence program, as shown in FIG. 3. Using said program, the microcontroller (1) controls the CI-CMOS (A) (4) and the CI-CMOS (B) (6), which in turn control the columns of the LED matrix (3) and provide the power to the rows of the LED matrix (3).

With reference to FIG. 2, when the luminaire is turned on, Vss powers both the microcontroller (1) and the FVC (2) at the grid voltage, which may be between 6 and 15 V DC, which triggers the step sequence of the program of the microcontroller (1).

The voltage output of the FVC (2) is 5 V, operating the CI-CMOS (A) and (B) ((4) and (6) respectively). After ten complete cycles of the sequence of the program, the frequency at (a) reaches the maximum required by the FVC (2) with an increase of 10% for each cycle, so that it provides the CI-CMOS (A) and (B) ((4) and (6) respectively) with a value close to Vss, such that the lighting reaches the maximum level thereof.

The Control In and Control Out lines are used to control the different display patterns of the luminaire from an external command, while Control In is not connected to the external command R1, it will keep (c) high and the luminous display will be permanent.

Description of Operation of the Program of the Microcontroller in said Embodiment of the Invention When the step sequence of the program of the microcontroller is started, the output pins (a), (b) and (d) to (m) are configured, see FIG. 2, as is input pin (c). Cnt1 and Cnt2 switch to 10; the delay function is called, the waiting time of which is defined by the value of Cnt1 and the multiplexing cycle is started.

As mentioned above, FIG. 3 shows how two variables Cnt1 and Cnt2 are managed during the step sequence of the program of the microcontroller. The value of Cnt1 is the multiplier of the delay for the entire process, and Cnt2 is a permanent counter that handles the output variation to the matrix (3). When Cnt2 is equal to 10, the active output will be (d) and each decrement unit corresponds to the following output. Consequently, when Cnt2=9 the active output will be (e), when Cnt2=8 the active output will be (f), when Cnt2=7 the active output will be (g), when Cnt2=6 the active output will be (h), when Cnt2=5 the active output will be (i), when Cnt2=4 the active output will be (j), when Cnt2=3 the active output will be (k), when Cnt2=2 the active output will be (l) and when Cnt2=1 the active output will be (m). The output (a) that goes to the FVC (2) is identical to the output (m). Nonetheless, a different pin is used to prevent the risk of overloading.

Multiplexing Cycle in said Embodiment of the Invention

The multiplexing cycle is run indefinitely until the luminaire is turned off. In the first ten cycles there is a consistent change in a decrement of the time in the delay function so that there is time to stabilize the internal oscillator of the microcontroller (1). The cycle starts by making the output (b) high and matches the state of the output (d) to the datum read at the input (c), then it waits the time defined by delay, decreases Cnt2 and switches (b) and (d) back to low, before returning to the point of the first call to the delay function. On returning to the decision point at which Cnt2 is compared, the value of Cnt2 will have had a decrement of one unit, on account of which the active output is no longer (d) but (e) and so on until (m) is reached.

Reduction of Cnt1 in said Embodiment of the Invention

In the final multiplexing cycle when Cnt2=0 and the active output is (m), the decision point Cnt2>0 sends the step of the program to the second decision point Cnt1>1. This will be true for the first nine cycles of the program, but from the ninth it will always be false, moving the step of the program to the reload of Cnt2 and therefore restarting the multiplexing cycle.

This configuration of physical elements and control step sequence program of the microcontroller of the luminaire according to the invention provides illumination of between 700 and 1400 lumens with a maximum power consumption of 2 W, which represents a saving of between 60% and 90% compared to the power consumption of existing LED luminaires and up to 98% compared to fluorescent luminaires.

This luminaire can replace any luminaire on the market since the multiplexed matrix can be distributed in any form and direction per LED unit. Furthermore, this feature enables it to be turned into a room lighting system in which the matrix is distributed not on the luminaire but over the area in order to illuminate specific areas and not a specific spectrum.

It can therefore be used to replace bulbs, tubes, downlights, floor lamps, halogen lamps, dichroic lamps, etc.

EXAMPLES

Example 1

The multiplexed LED luminaire according to the present invention (JCDLLM08) was compared with a 50 W dichroic lamp, and in this case the dichroic lamp provided a light flux of 650 lumens at a distance of one meter. The LED luminaire according to the present invention (JCDLLM08), using a matrix of 20 LEDs and consuming 0.82 W of power, provided a light flux of 546 lumens at a distance of one meter. The table below sets out the comparative results.

TABLE 1

| Luminaire | Power consumption | Light flux | Luminous efficiency | Percentage saving W | Improvement in luminous efficiency |
|---|---|---|---|---|---|
| Dichroic | 50 W | 650 Lux | 13 lumens/W | | |
| JCDLLM08 | 0.82 W | 546 Lux | 665.8 lumens/W | 98.36% | 98.04% |

Example 2

The multiplexed LED luminaire according to the present invention (JCDLLM08) was compared with an 18 W fluorescent energy-saving bulb, and the energy saving bulb provided a light flux of 750 lumens at a distance of one meter. The luminaire according to the invention (JCDLLM08), using a matrix of 100 LEDs and consuming 1.42 W of power, provided a light flux of 600 lumens at a distance of one meter. The table below sets out the comparative results.

TABLE 2

| Luminaire | Power consumption | Light flux | Luminous efficiency | Percentage saving W | Improvement in luminous efficiency |
|---|---|---|---|---|---|
| Energy-saving bulb | 15 W | 750 Lux | 50 lumens/W | | |
| JCDLLM08 | 1.42 W | 600 Lux | 423 lumens/W | 89.43% | 88.18% |

Discussion of results: The data in tables 1 and 2 show that the luminaire according to the present invention provides not only a considerable energy saving, but also an improvement in luminous efficiency.

The invention claimed is:

1. An ultra-low-power luminaire powered by between 6 and 15 V (Vss) comprising an LED matrix with anodes in columns and cathodes in rows;

a microcontroller that controls the multiplexing cycle;

a voltage regulator that provides a voltage for the microcontroller;

Control In input and output (clk) lines that connect to the luminaire and that enable the different display patterns of the luminaire to be controlled;

a decade counter (CMOS) and a CMOS NOT gate array that control the power of the LED matrix;

a frequency-to-voltage converter (FVC) that controls the CMOS and CMOS NOT power supply;

wherein the microcontroller receives information from the control in input line and supplies information (signal) to the frequency-to-voltage converter (FVC), to CMOS and to CMOS NOT, and the FVC provides a supply voltage as a function of the frequency of the microcontroller to the CMOS and CMOS NOT circuits, and wherein the frequency between the microcontroller and the FVC is ten times the initial frequency and in this state the FVC delivers a value substantially equal to the power supply voltage (Vss) to the CMOS and CMOS NOT.

2. The luminaire as claimed in claim 1, wherein the voltage provided by the voltage regulator to the microcontroller is 5 V.

3. The luminaire as claimed in claim 1, wherein the CMOS decade counter is a CI-CMOS (A) decade divider and the CMOS NOT gate array corresponds to CI-CMOS(B) logical NOT gates.

4. The luminaire as claimed in claim 1, wherein the microcontroller has 10 output pins to the CI-CMOS(B) corresponding to pins (d) to (m).

5. The luminaire as claimed in claim 1, wherein the FVC is set up as a frequency-to-voltage converter FVC.

6. The steps of the program of the microcontroller of a luminaire as claimed in claim 1, including the following steps:

i. beginning with the configuration of the outputs and inputs corresponding to the output (I) of the microcontroller (1) to the FVC, the output (II) of the microcontroller to the CMOS decade counter, the output pins (IV) of the microcontroller to the CMOS NOT, and configuring the input (VI) to the microcontroller and loading the counters Cnt1 and Cnt2;

ii. Starting the multiplexing cycle;

wherein the multiplexing cycle includes the following steps:

A. calling the delay function for a first time, which has a time defined by the value of Cnt1;

B. Sending a clock pulse to the CMOS;

C. sequentially activating the outputs (IV) of the microcontroller to the CMOS;

D. matching the state of the active output (IV) to the value read from the input (VI) of the microcontroller;

E. calling the delay function for a second time, which has a time defined by the value of Cnt1;

F. returning to step A of the first delay function call;

iii. comparing the value of Cnt1 with 1; if it is greater than or equal to 1, decrease Cnt1 and return to step (ii), and if Cnt1 is less than 1, return directly to step (ii), restarting the multiplexing cycle.

7. The steps of the program of the microcontroller as claimed in claim 6, including the following steps:

i. starting the configuration of the outputs and inputs corresponding to pins (a), (b), (d), (e), (f), (g), (h), (i), (j), (k), (l), (m) and (c) of the microcontroller (1);

ii. making Cnt1 equal to 10;

iii. making Cnt2 equal to 10;

iv. comparing the value of Cnt2 with 0 and starting the multiplexing cycle, which is run until the luminaire is turned off;

wherein the multiplexing cycle includes the following steps:

A. calling the delay function for a first time, which has a time defined by the value of Cnt1;

B. making the output (b) of the microcontroller equal to 1;

C. activating the output, which corresponds to one of the pins (d) to (m) of the microcontroller, which when Cnt2 is equal to 10 the active output is (d);

D. matching the state of the active output to the value read from the input (c) of the microcontroller;

E. calling the delay function for a second time, which has a time defined by the value of Cnt1;

F. decreasing Cnt2, each decrement unit makes the active output the next output pin of the microcontroller to the illumination power regulator;

G. making the output (b) of the microcontroller and the active output equal to 0;

H. returning to step A of the first delay function call;

v. Comparing the value of Cnt1 with 1; if it is greater than or equal to 1, decrease Cnt1 and return to the start of the multiplexing cycle, and if Cnt1 is less than 1, return directly to the multiplexing cycle.

* * * * *